US012704338B2

(12) United States Patent
Lipowski

(10) Patent No.: US 12,704,338 B2
(45) Date of Patent: Aug. 11, 2026

(54) TRIGGER DEVICE

(71) Applicant: 2360216 Ontario Inc., Mississauga (CA)

(72) Inventor: Mats Lipowski, Mississauga (CA)

(73) Assignee: 2360216 Ontario Inc., Mississauga (CA)

( * ) Notice: Subject to any disclaimer, the term of this patent is extended or adjusted under 35 U.S.C. 154(b) by 252 days.

(21) Appl. No.: 18/491,010

(22) Filed: Oct. 20, 2023

(65) Prior Publication Data

US 2024/0044599 A1 Feb. 8, 2024

Related U.S. Application Data

(63) Continuation of application No. 17/620,006, filed as application No. PCT/CA2020/050851 on Jun. 19, 2020, now Pat. No. 11,841,199.

(60) Provisional application No. 62/863,633, filed on Jun. 19, 2019.

(51) Int. Cl.

| | |
|---|---|
| ***F41A 19/16*** | (2006.01) |
| ***F41A 19/10*** | (2006.01) |
| ***F41A 19/12*** | (2006.01) |

(52) U.S. Cl.
CPC ..... *F41A 19/16* (2013.01); *F41A 19/10* (2013.01); *F41A 19/12* (2013.01)

(58) Field of Classification Search
CPC ..... F41A 19/15; F41A 19/10; F41A 19/12; F41A 19/16
USPC ..... 42/69.01–69.2
See application file for complete search history.

(56) References Cited

U.S. PATENT DOCUMENTS

| | | | | |
|---|---|---|---|---|
| 2,249,232 A * | 7/1941 | Smith | F41A 19/31 | 74/2 |
| 7,047,685 B2 * | 5/2006 | Diaz | F41A 19/16 | 42/69.02 |
| 8,966,802 B1 * | 3/2015 | Findlay | F41A 19/12 | 42/69.01 |

* cited by examiner

*Primary Examiner* — Reginald S Tillman, Jr.
(74) *Attorney, Agent, or Firm* — Perry + Currier

(57) ABSTRACT

A trigger device for activating a firing mechanism is described. The trigger device comprises a housing, a sear, and a trigger. The sear is pivotally mounted on the housing via a sear pivot pin. The trigger is pivotally mounted on the housing via a trigger pivot pin. The trigger comprises a trigger extender. The trigger extender inhibits unloading the sear until the trigger is rotated from a ready position.

6 Claims, 10 Drawing Sheets

TRIGGER DEVICE

RELATED APPLICATIONS

The present application is continuation of U.S. patent application Ser. No. 17/620,006, filed on Dec. 16, 2021, which is a U.S. National Stage application under 35 USC 371 of PCT Application Serial No. PCT/CA2020/050851, filed on 19 Jun. 2020; which claims priority from U.S. Patent Application No. 62/863,633, filed 19 Jun. 2019, the entirety of both of which are incorporated herein by reference.

The present disclosure relates generally to firearms and more specifically to a trigger device with an improved shock-safety.

BACKGROUND

A firing mechanism is used to actuate the sequence of a firearm or crossbow by movement of a trigger. The trigger is generally activated by imposing a trigger pull load on the trigger, causing the trigger to move from a loaded position, at which the firing mechanism is activatable, to a released position, at which the firing mechanism is activated. As is well known, it is desirable for the trigger pull load to be predictable. For example, firing a firearm is more accurate if the trigger pull load is consistent for the user.

There are competing factors to be taken into account in determining the trigger pull load required to pull the trigger. For example, if the trigger pull load is relatively large, inadvertent activation of the firing mechanism is unlikely thereby increasing safety of the firearm. On the other hand, if the trigger pull load is relatively small, activating the firing mechanism is relatively easy thereby reducing the effect of activating the trigger on accuracy of the firearm. Further, a small trigger pull load may increase the frequency at which the firearm can be activated.

For highly accurate target or hunting purposes, the vast majority of firearm operators have a preferred trigger pull load. Most known trigger mechanisms have a spring bias imparted to the trigger to oppose trigger movement by the operator. Adjusting the compression or tension forces in the spring opposing the movement of the trigger will modify the force resisting the trigger movement.

Some shooters prefer what is known as a two-stage trigger. In a first stage, a first-stage trigger pull load is required to move the trigger to a position just short of that required to release the sear and fire the firearm. At the end of the first stage, the trigger encounters additional resistance. The additional resistance indicates to the operator that the trigger has entered the second stage and is ready for firing by the application of a second stage trigger pull load to the trigger. The extent of the first and second stage pull load is a matter of choice of the firearm operator, although it often has to be determined in advance and is set prior to installation of the trigger.

However, two-stage triggers are more complex than single-stage triggers and often require additional spacing in the firearm, when space may be limited. For example, some known two-stage triggers are not feasible for use with firearms, such as rifles for example, due to limited space in the firearm.

Although various attempts have been made to improve the performance of a trigger in a firearm, further improvements are desired. It is therefore an object at least to provide a novel two-stage trigger device.

SUMMARY

In accordance with an aspect of an embodiment, there is provided a trigger device comprising: a housing; a trigger rotatably mounted in the housing via a trigger pivot pin, the trigger comprising a trigger tooth; a reverser rotatably mounted in the housing via a reverser pivot pin, the reverser comprising a reverser tooth; a first pull weight adjustment mechanism coupled between the trigger and the reverser to bias the trigger in a first direction and the reverser in an opposite direction; wherein actuation of the trigger causes the trigger to rotate in the opposite direction, the trigger tooth to engage the reverser tooth, and the reverser to rotate in the first direction.

The trigger device may further comprise a ticker rotatably mounted in the housing via a ticker pivot pin, wherein the ticker is configured to rotate when pressure applied to of the trigger is sufficient to overcoming the bias of the first pull weight adjust mechanism; and a sear configured to unload when the ticker rotates to a predefined tipping point.

The trigger device may further comprise a captured roller positioned between the ticker and the sear, the captured roller configured to increasingly translate upon rotation of the ticker; wherein the tipping point is defined by an amount of translation of the captured roller.

In an embodiment, there may be a recess in the ticker and a trigger extender on the trigger, wherein the trigger extender is positioned to abut the ticker when the trigger is released and the trigger extender is positioned over the recess when pressure is applied to the trigger.

The trigger device may further comprise a second pull weight adjustment mechanism to bias the ticker to maintain the sear in a loaded position. The ticker rotates to the predefined tipping point when pressure applied to of the trigger is sufficient to overcoming the bias of the first pull weight adjust mechanism and the bias of the second pull weight adjust mechanism. The first pull weight may be greater than the second pull weight or the second pull weight may be greater than the first pull weight.

In accordance with another aspect of an embodiment, there is provided a trigger device for activating a firing mechanism, the trigger device comprising: a housing; a trigger pivotally mounted on the housing via a trigger pivot pin, the trigger comprising a trigger extender; a sear pivotally mounted on the housing via a sear pivot pin; and a ticker pivotally mounted on the housing via a sear pivot pin, the ticker comprising a recess and configured to translate pressure applied to the trigger to the sear to activate the firing mechanism; wherein the trigger extender is positioned to abut the ticker when the trigger is released and the trigger extender is positioned over the recess when pressure is applied to the trigger.

In accordance with another aspect of an embodiment, there is provided a trigger device for activating a firing mechanism, the trigger device comprising: a housing; a sear pivotally mounted on the housing via a sear pivot pin; and a trigger pivotally mounted on the housing via a trigger pivot pin, the trigger comprising a trigger extender; wherein the trigger extender inhibits unloading the sear until the trigger is rotated to a ready position.

The trigger extender may be nestled within the recess when the sear is unloaded. The recess may be configured to inhibit the trigger from returning to the ready position until the sear is reloaded.

BRIEF DESCRIPTION OF THE DRAWINGS

Embodiments will now be described by way of example only with reference to the accompanying drawings in which:

FIG. 1 b as a cross-sectional view of FIG. 1*a*.

DETAILED DESCRIPTION OF THE EMBODIMENTS

Figure 1A:
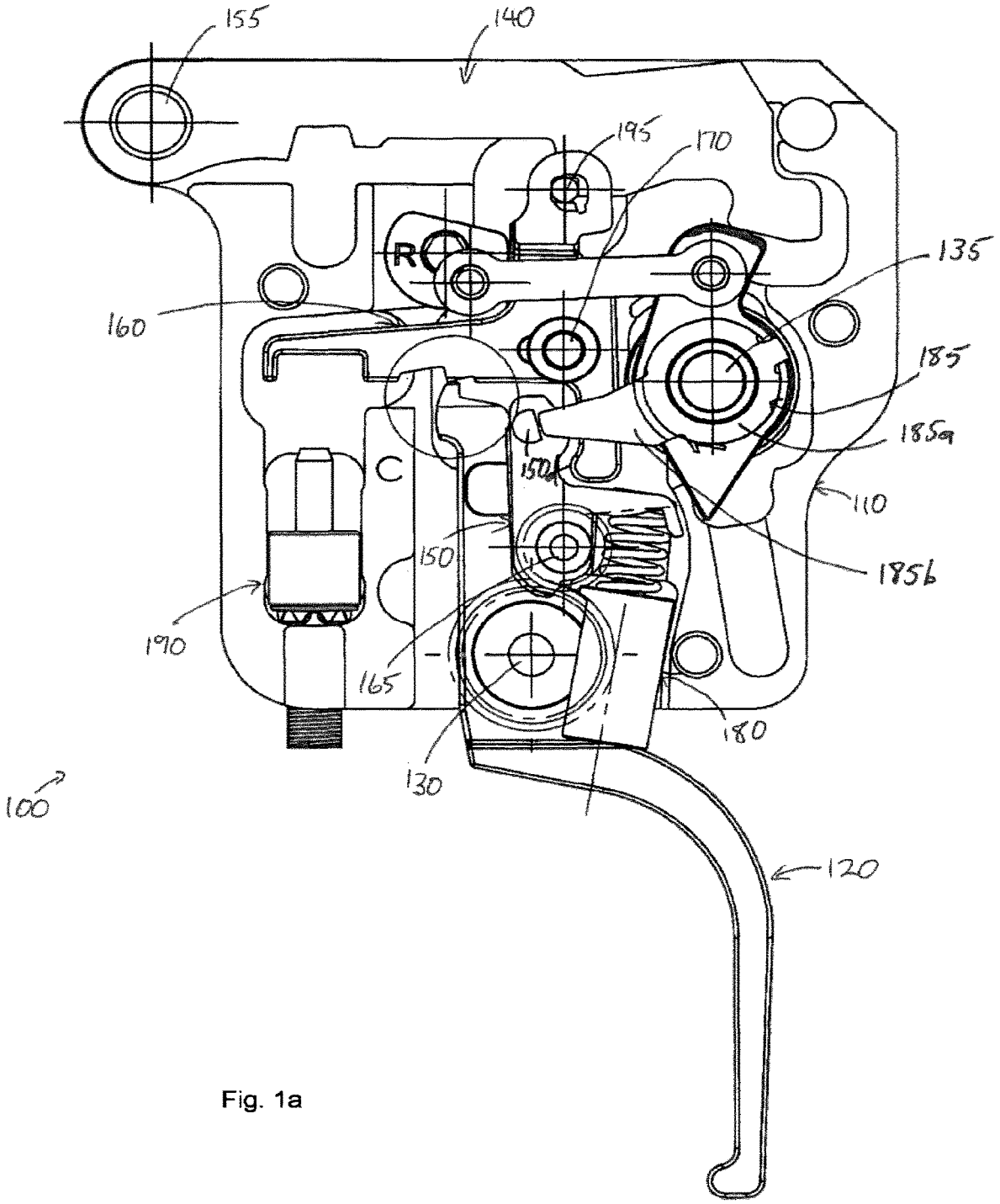
FIG. 1 a is a side view of the trigger device shown in a position in which the sear is loaded and the trigger actuation lever is released.
FIG. 1*c* is an detailed view of an interface between the trigger and the first pull weight adjustment mechanism.
Figure 1B:
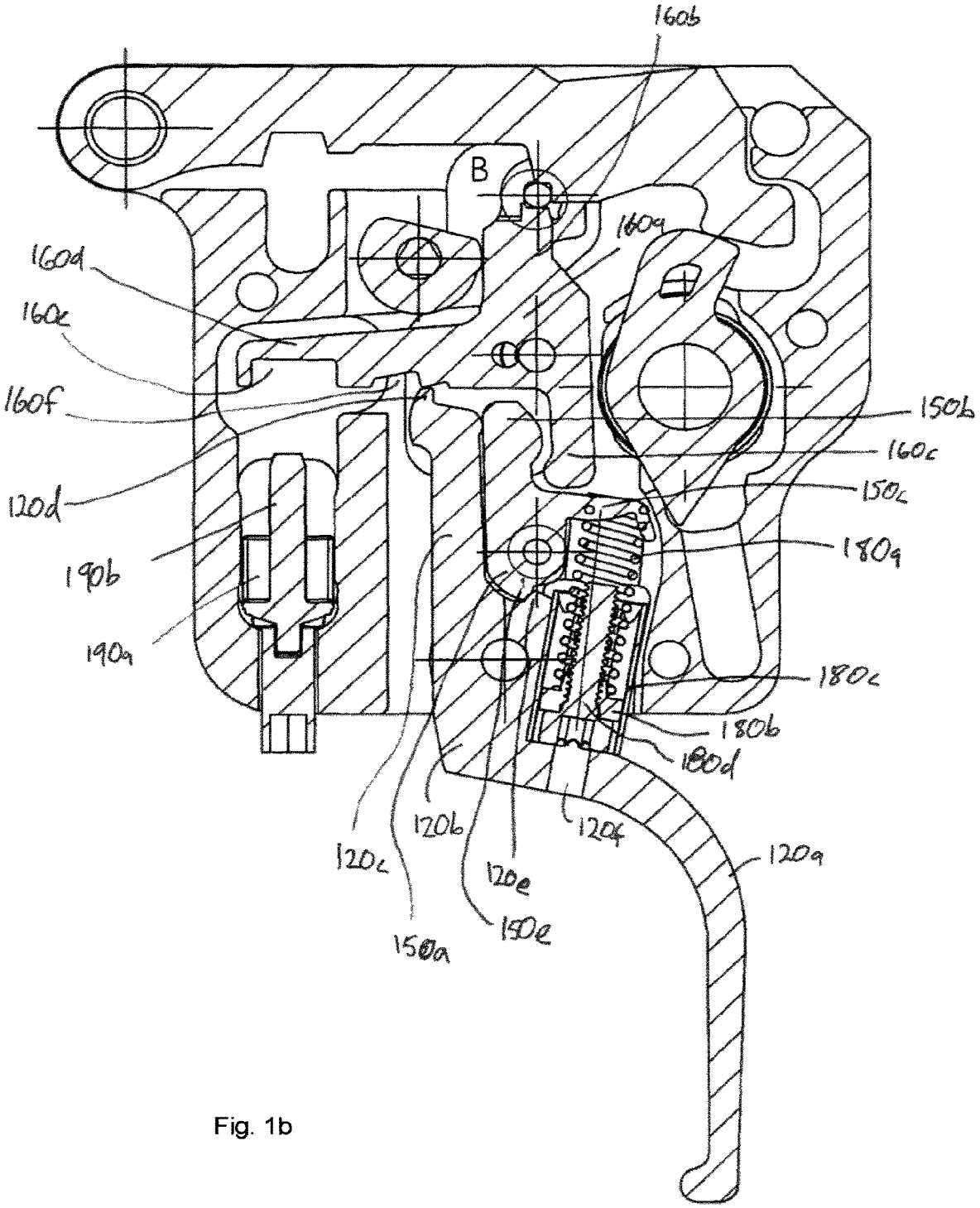
Figure 1C:
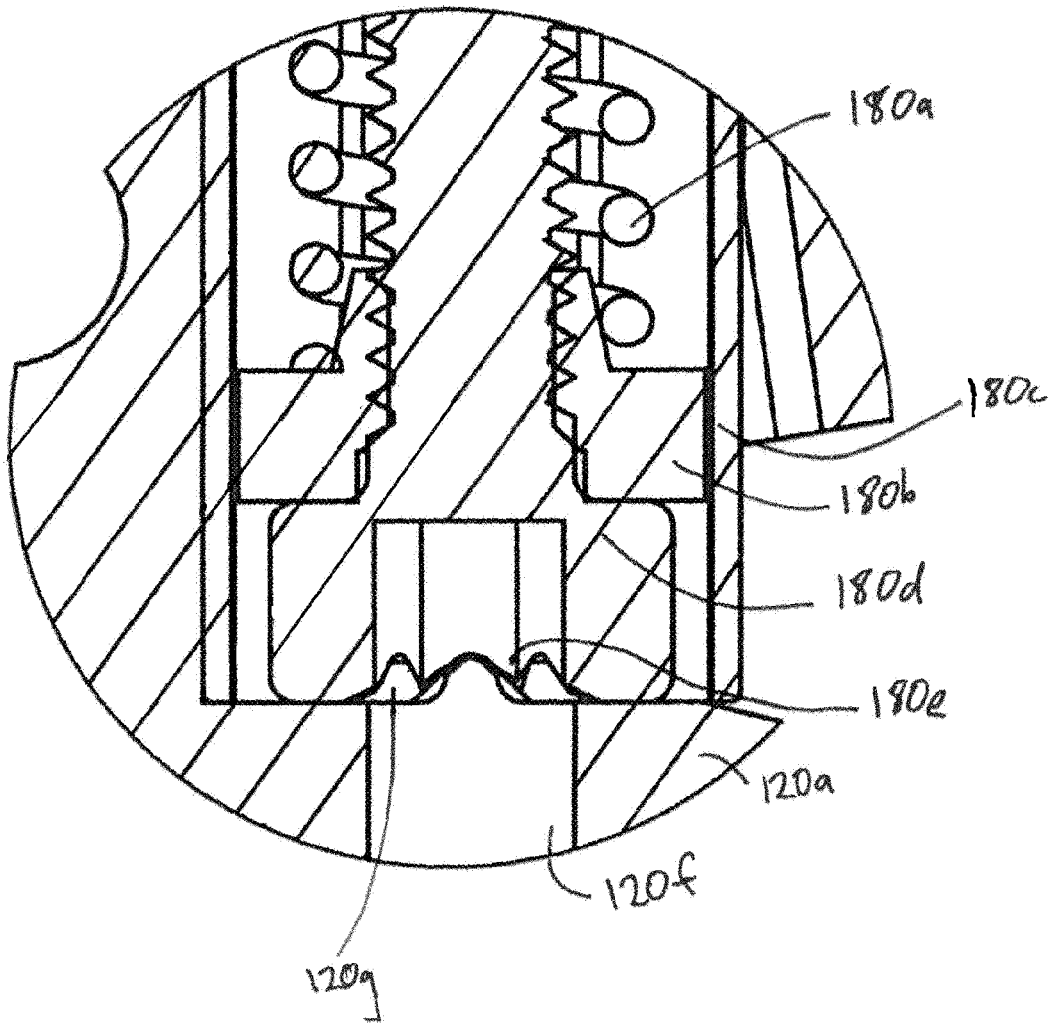

For convenience, like numerals in the description refer to like structures in the drawings. Referring to FIGS. 1*a*, 1*b*, and 1*c*, a trigger device for activating a firing mechanism of a firearm is illustrated generally by reference numeral 100. The trigger device 100 comprises a housing 110, a trigger 120, a trigger pivot pin 130, a sear 140, a sear pivot pin 155, a ticker 160, a ticker pivot pin 170, a captured roller 195, a reverser 150, a reverser pivot pin 165, a first pull weight adjustment mechanism 180, a second pull weight adjustment mechanism 190, a safety 185, and a safety pivot pin 135.

The trigger 120 comprises an actuation member 120*a*, a central portion 120*b*, a trigger flat 120*c*, an trigger extender 120*d*, and a trigger tooth 120*e*. The central portion 120*b* is rotationally coupled to the trigger pivot pin 130 and comprises the trigger tooth 120*e*. The actuation member 120*a* generally extends from the central portion 120*b* such that it protrudes from the housing 110. The actuation member 120*a* is configured to interface with a finger of an operator of the firearm. In most embodiments the actuation member 120*a* will be arcuate. The trigger flat 120*c* generally extends from the central portion 120*b* towards an interior of the housing 110. The trigger extender 120*d* is a protrusion or hook located at a distal end of the trigger flat 120. The trigger extender 120*d* extends radially further from the central portion 120*b* than the trigger flat 120*c*. The trigger 120 further include a hole 120*f*, extending though the actuation member 120*a*. A plurality of wedge-shaped protrusions 120*g* are positioned around the hole 120*f* on an upper surface of the actuation member 120*a*.

The reverser 150 comprises a main portion 150*a*, a reverser flat 150*b*, a reverser arm 150*c*, a reverser nub 150*d*, and a reverser tooth 150*e*. The main portion 150*a* is rotationally coupled to the reverser pivot pin 165 and comprises the reverser tooth 150*e*. The reverser flat 150*b* generally extends from the main portion 150*a*. The reverser arm 150*c* extends from a mid-portion of the reverser flat 150*b*. The reverser nub 150*d* protrudes from reverser flat 150*b*.

The ticker 160 comprises a main portion 160*a*, a sear-engagement portion 160*b*, a reverser engagement portion 160*c*, and a ticker arm 160*d*. The main portion 160*a* is rotationally coupled to the ticker pivot pin 170. The sear engagement portion 106*b* and the reverser engagement portion 160*c* extend from the main portion 160*a* in opposing directions. The ticker arm 160*d* extends from the main portion 160*a* in a direction substantially perpendicular to the sear engagement portion 106*b* and the reverser engagement portion 160*c* The ticker arm 160*d* comprises a recess 160*e* proximal its distal end and a notch 160*f* proximal its mid portion.

The second pull weight adjustment mechanism 190 comprises a spring (not shown), a feedback member 190*a*, and a threaded wedge screw 190*b*. The feedback member 190*a* comprises a plurality of wedge shaped projections spaced about its surface. A first end of the threaded wedge screw 190*b* is generally shaped to be complementary to the wedge shaped projections on the feedback member 190*a*. A second end of the threaded wedge screw 190*b* comprises a socket configured to receive a tool. For example, the socket can be a hexagonal socket and the tool can be an Allen key, hex key, screwdriver, or the like. The second pull weight adjustment mechanism 190 is described in greater detail in U.S. Pat. No. 9,752,841 (referred to herein as the '841 patent).

The first pull weight adjustment mechanism 180 is similar to the second pull weight adjustment mechanism 190. The first pull weight adjustment mechanism 180 comprises a spring 180*a*, a nut 180*b*, a nut guide 180*c*, and an adjustment screw 180*d*. The adjustment screw 180*d* comprises a plurality of wedge shaped protrusions 180*e* spaced about a surface of its head. The adjustment screw 180*d* also comprises a socket configured to receive a tool, such as an Allen key, hex key, screwdriver, or the like.

The safety 185 includes a main portion 185*a* and a safety arm 185*b*. The main portion 185*a* is rotationally coupled to the safety pivot pin 135. The safety arm 185*b* protrudes radially from the main portion 185*a*.

The trigger 120 is pivotally mounted on the housing 110 via the trigger pivot pin 130. The sear 140 is pivotally mounted on the housing via the sear pivot pin 155. The ticker 160 is pivotally mounted on the housing 110 via the ticker pivot pin 170. The reverser 150 is pivotally mounted on the housing 110 via the reverser pivot pin 165.

The reverser 150 is positioned adjacent the trigger 120. Specifically, the main portion 150*a* of the reverser 150 is positioned adjacent the central portion 120*c* of the trigger 120 so that the reverser tooth 150*e* abuts the trigger tooth 120*e*, effectively forming a single tooth gear between the reverser 150 and the trigger 120. Further, the reverser flat 150*b* is positioned adjacent the trigger flat 120*c*.

The first pull weight adjustment mechanism 180 is coupled between a top portion of the trigger actuation member 120*a* and the reverser arm 150*c*. In an embodiment, the spring 180*a* is a coil and is coupled at one end to the reverser arm 150*c* and at another end to the nut 180*b*. The nut 180*b* is positioned with nut guide 180*c* and is movable therein upon rotation of the adjustment screw 180*d*. The wedge shape protrusions 180*e* on the adjustment screw 180*d* are configured to be complementary with the wedge shaped protrusions 120*g* on the trigger actuation member 120*a* and interlock therewith.

As noted above, the trigger tooth 120*e* abuts the reverser tooth 150*e*. Further, the trigger protrusion 120*d* abuts the sear arm 160*d* adjacent to the notch 160*f* in the sear arm 160*d*.

The spring 180*a* of the first pull weight adjustment mechanism 180 is configured to bias the reverser 150 to rotate counter-clockwise about the reverser pivot pin 165. Conversely, the spring 180*a* of the first pull weight mechanism 180 is configured to bias the trigger 120 to rotate clockwise about the trigger pivot pin 130. These forces bias the reverser tooth 150*e* and the trigger tooth 120*e* together. The force required to overcome the bias of the first pull weight mechanism 180 is the pull load for the first stage of the trigger device 100.

When the sear 140 is loaded, it is biased by a spring (not shown) to rotate clockwise about the sear pivot pin 155. Similarly, the spring of the second pull weight adjustment mechanism 190 is configured to bias the ticker 160 to rotate clockwise about the ticker pivot pin 170. These forces bias the sear 140 and the sear engagement portion 160*b* of the ticker 160 to trap the roller 195 there between. The force required to overcome the bias of the second pull weight mechanism 190 and unload the sear 140 is the pull load for the second stage of the trigger device 100.

Referring to FIGS. 1*a* and 1*b*, the trigger device 100 is shown in a position in which the sear 140 is loaded and the trigger actuation lever 120*a* is released. Additionally, the safety 185 is in a "lock" position and the safety arm 185*b* engages the nub 150*d* on the reverser 150. If one was to apply pressure to the trigger actuation lever 120*a* in an attempt fire the firearm, the safety arm 185*b* would contact the nub 150*d*, inhibiting movement of the reverser 150. This, in turn, would inhibit movement of the trigger 120 as the reverser tooth 150*e* would inhibit movement of the trigger tooth 120.

Additionally, the abutment of trigger extender 120*d* with the ticker arm 160*d* provides a further safety mechanism. Consider, for example, an instance in which the trigger device 100 experiences a shock, such as if the firearm is dropped. If the shock imparts sufficient force to overcome the bias of the second pull weight adjustment mechanism 190, in the absence of the trigger extender 120*d*, the ticker 160 would rotate counter-clockwise allowing sear 140 to unload and the firearm to fire (as will be described in greater detail below). This would occur even if the trigger actuator 120*a* had not been moved and even if the safety is in the "lock" position. However, the presence of the trigger extender 120*d* inhibits the ticker 160 from rotating unless the trigger actuator 120*a* has physically been moved. Thus, even in the case of a drop, it is unlikely that firearm would fire accidentally. This additional safety mechanism allows the operator to safely set the bias force of the second pull weight adjustment mechanism 190 to a relatively low number, if desired.

Figure 2A:
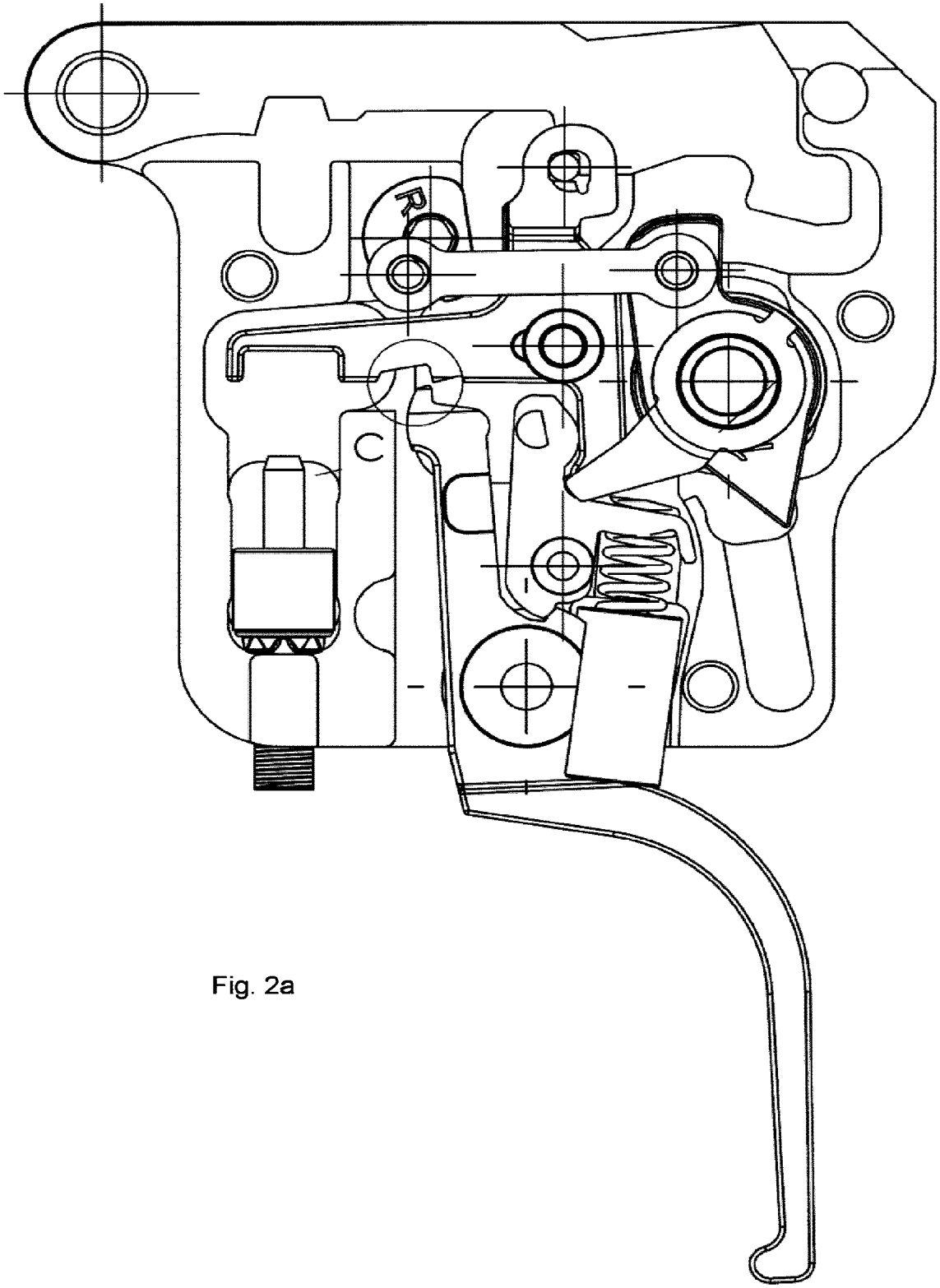
FIG. 2*a* is a side view of the trigger device shown in a position in which the sear is loaded and pressure sufficient to overcome a first stage is applied to the trigger actuation lever.
Figure 2B:
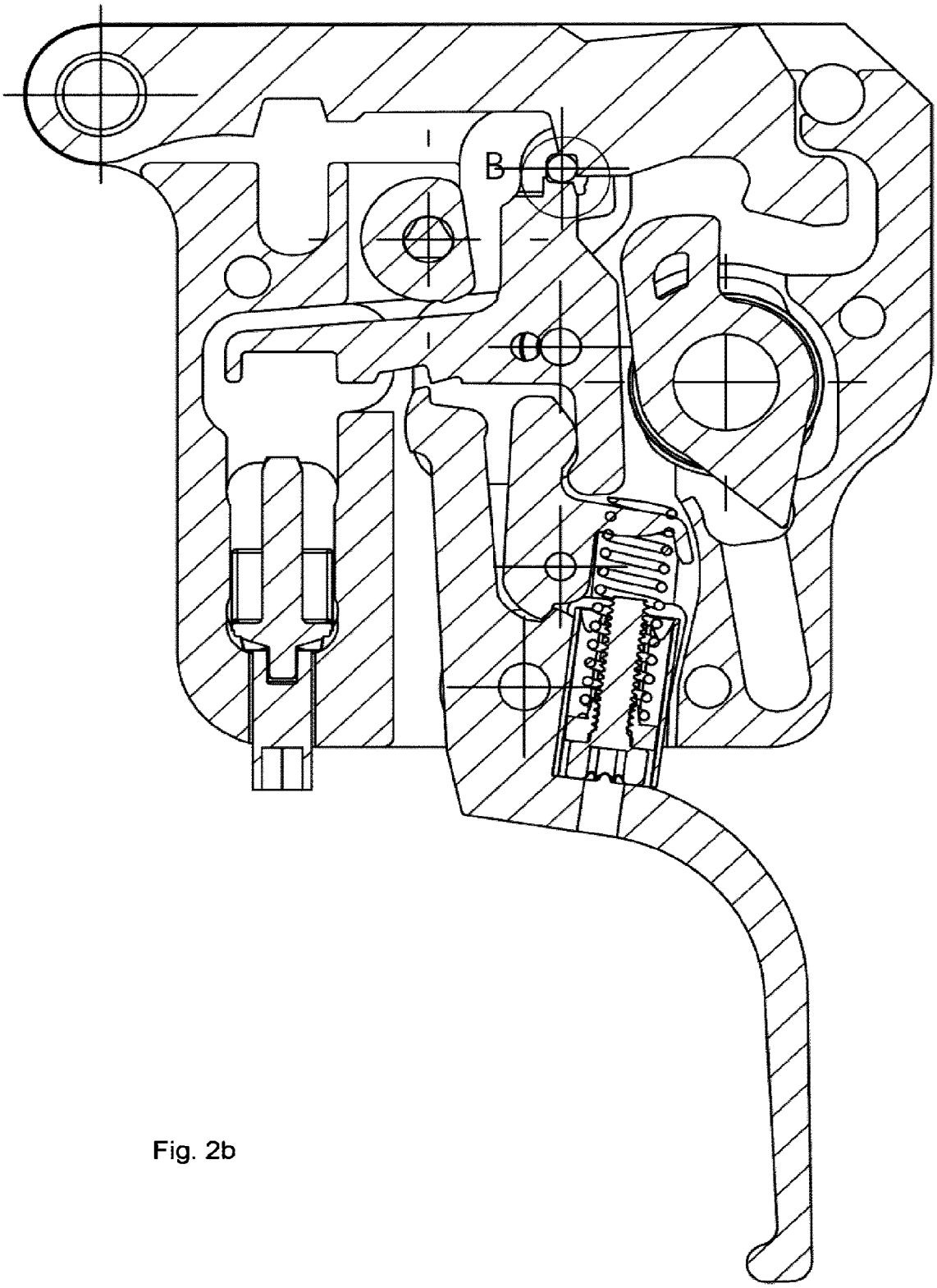
FIG. 2*b* is a cross-sectional view of FIG. 2*a*.

Referring to FIGS. 2*a* and 2*b*, the trigger device 100 is shown in a position in which the sear 140 is loaded and pressure is being applied to the trigger actuation lever 120*a*. Additionally, the safety 185 is in an "unlocked" position and the safety arm 185*b* is disengaged from the nub 150*d* on the reverser 150. As pressure is applied to the trigger actuation lever 120*a*, the trigger 120 rotates counter-clockwise about the trigger pivot pin 130. The trigger tooth 120*e* applies pressure to the reverser tooth 150*e* which, in turn, rotates the reverser 150 clockwise about the reverser pivot pin 165.

Since a combination of the trigger 120 and the reverser 150 apply force to the first pull weight mechanism 180, the force applied to the first pull weight mechanism 180 is greater than the force applied to the trigger 120 actuator 120*a*. Since smaller springs typically require a greater compression force than larger springs, this feature allows a smaller spring 180*a* to be used in the first pull weight mechanism 180 while achieving a similar pull load for the first stage of the trigger to state of the art trigger devices with longer springs. For example, in the configuration illustrated, the force applied to the spring 180*a* is approximately double the force applied to the trigger actuator 120*a*. Thus, the size of the spring 180*a* can be halved in comparison to prior art implementations, yet achieve similar pull loads. This size reduction is beneficial, as space is often in short supply.

In FIGS. 2*a* and 2*b*, a sufficient pull load has been applied to the trigger to overcome the first stage. The reverser flat 150*b* is in contact with the reverser engagement section 160*c* of the ticker 160. Accordingly, the trigger device 100 enters the second stage. Further, rotation of the trigger 120 positions the trigger extender 120*d* over the notch 160*f* in the ticker 160. In this position, the trigger 120 will no longer inhibit the ticker 160 from rotating. Accordingly, the trigger device 100 is ready to be fired upon application of the second stage pull load at the trigger actuator 120*a*.

Figure 3A:
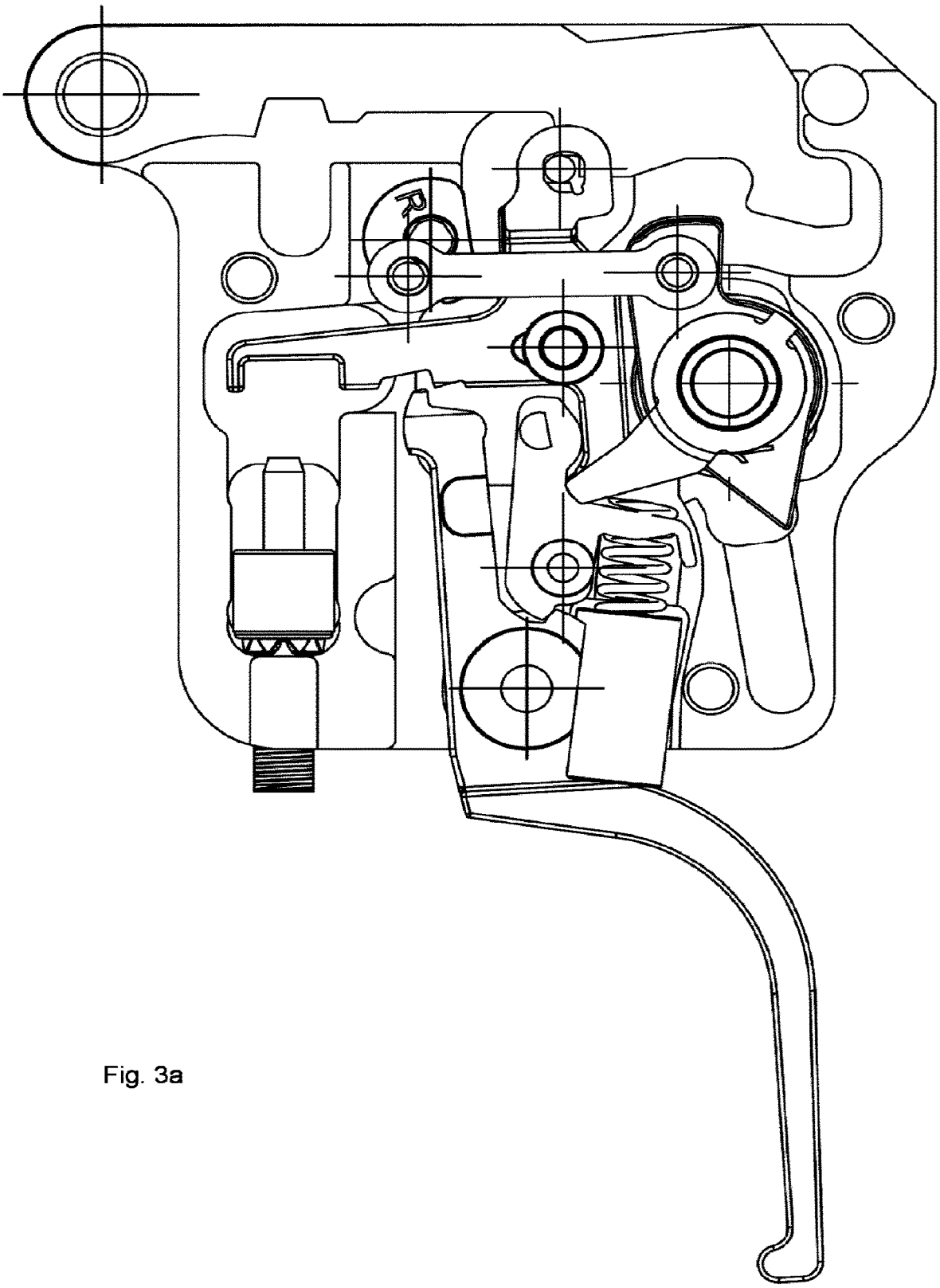
FIG. 3*a* is a side view of the trigger device shown in a position in which the sear is loaded and pressure sufficient to overcome a second stage is applied to the trigger actuation lever.
Figure 3B:
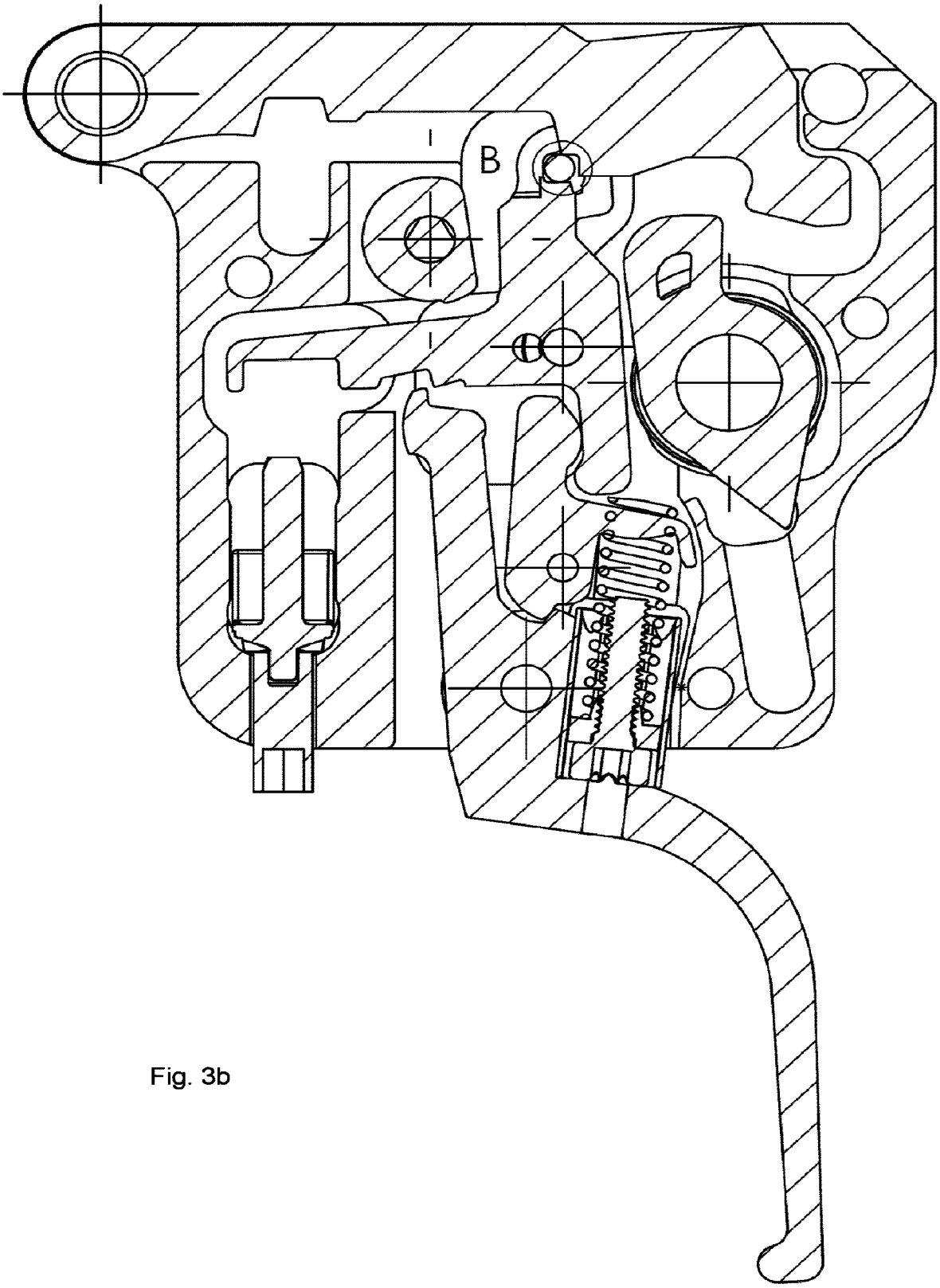
FIG. 3*b* is a cross-sectional view of FIG. 3*a*.

Referring to FIGS. 3*a* and 3*b*, the trigger device 100 is shown in a position in which the sear 140 is loaded and the pressure being applied to the trigger actuation lever 120*a* is sufficient to overcome the second stage. As pressure is applied to the trigger actuation lever 120*a* in the second stage, the reverser flat 150*b* applies pressure to the reverser engagement portion 160*c* of the ticker 160 which, in turn, rotates the ticker 150 counter-clockwise about the ticker pivot pin 170. Rotation of the ticker 150 disengages the sear engagement portion 160*b* of the ticker 160 which, in turn, allows translation of the roller 195. Details of the interaction between the roller 195, the ticker 160 and the sear 140 are provided in the '841 patent. Once the roller 195 is translated to a tipping point, the biasing force applied to the sear 140 overcomes the counteractive force applied by the ticker 160 and the sear unloads, firing the firing arm.

Figure 4A:
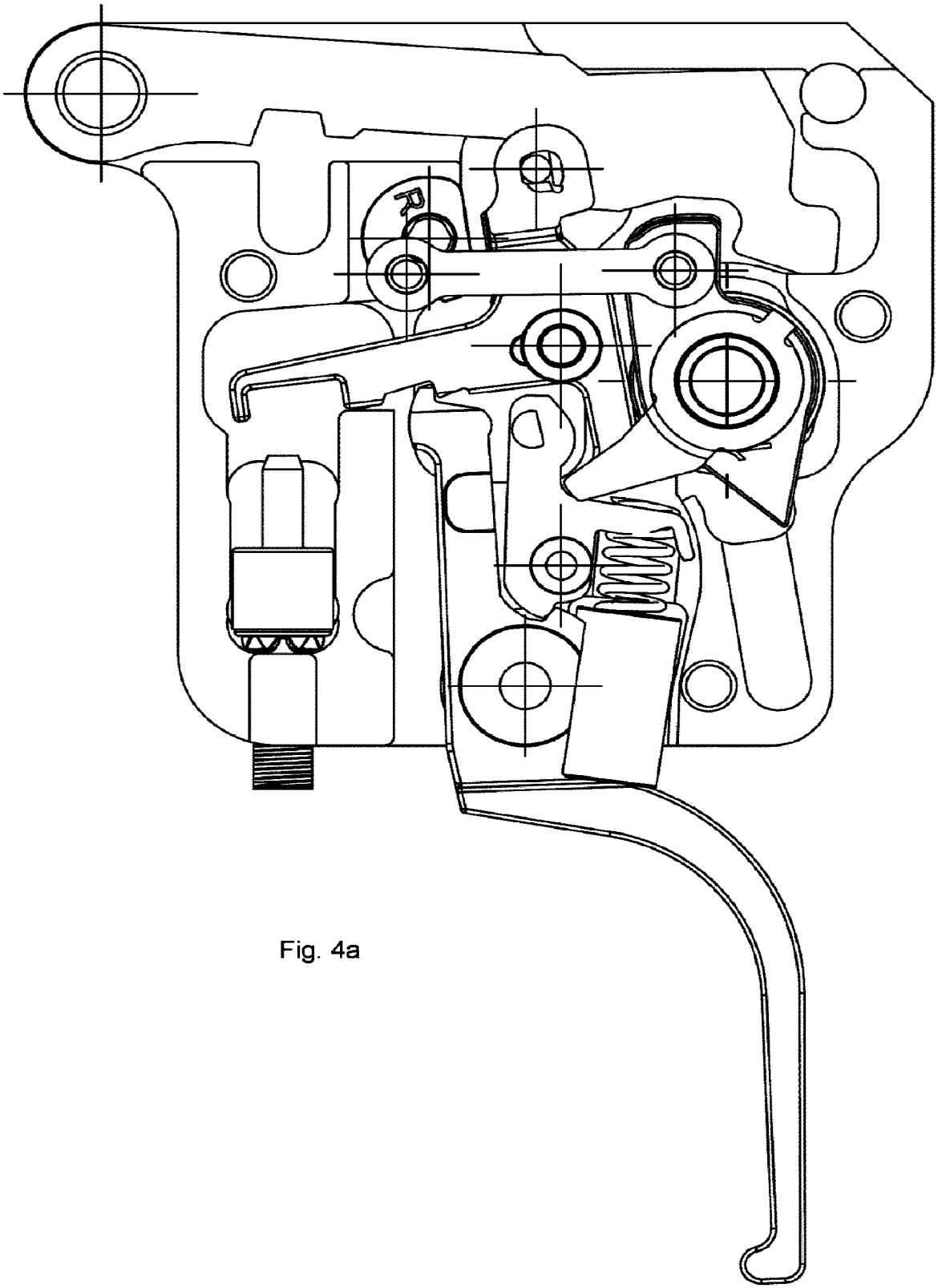
Fig. 4*a* is a side view of the trigger device shown in a position in which the sear is unloaded and the trigger actuation lever is released.
Figure 4B:
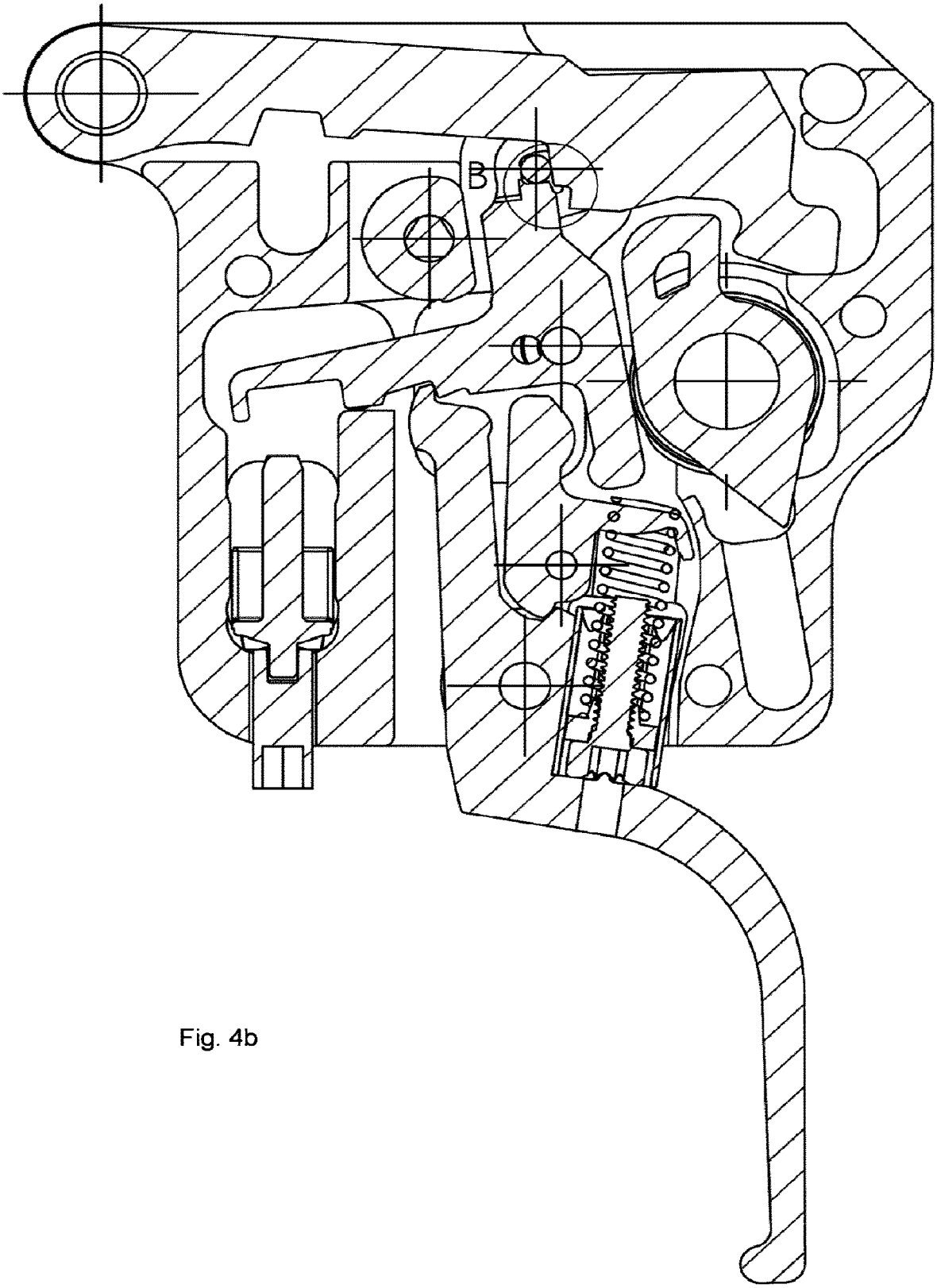
FIG. 4*b* is a cross-sectional view of FIG. 4*a*.

Referring to FIGS. 4*a* and 4*b*, the trigger device 100 is shown in a position in which the sear 140 is unloaded and the trigger actuation lever 120*a* is released. As illustrated, the trigger extension 120*d* is nestled within the notch 160*f* of the ticker 160, which allowed the ticker 160 to rotate and the sear 140 to unload. Upon loading of the sear 140, the ticker 160, the reverser 150, and the trigger 120 will return to the positions illustrated in FIGS. 1 and 1*a*.

Figure 5:
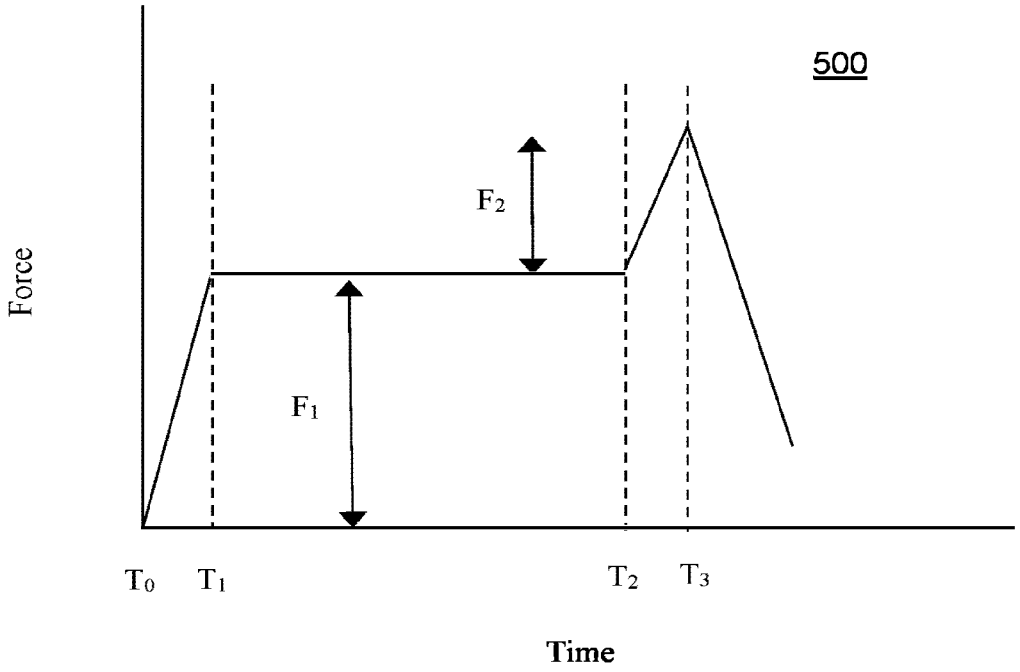
FIG. 5 is a graph illustrating the two-stage nature of the trigger.

Referring to FIG. 5, a graph illustrating the operation of the two-stage trigger is illustrated generally by number 500. Time $T_0$ is illustrated in FIGS. 1*a* and 1*b* when the trigger 120 is released and no force is applied to the trigger actuation lever 120*a*. From $T_0$ to $T_1$, an increasing force is applied to the trigger actuation lever 120*a* until the first pull load $F_1$ is reached. The first pull load $F_1$ overcomes the bias of the first pull weight adjustment mechanism 180. FIGS. 2*a* and 2*b* illustrate the trigger device 100 at this point. The first pull load $F_1$ is maintained until $T_2$, at which point it is desired to fire the trigger device 100. Accordingly, from $T_1$ to $T_2$, an increasing force is applied to the trigger actuation lever 120*a* until the second pull load $F_2$ is reached. The second pull load $F_2$ overcomes the bias of the second pull weight adjustment mechanism 180. FIGS. 3*a* and 3*b* illustrate the trigger device 100 at this point. As shown, once the second pull load $F_2$ is reached, the ticker 160 has rotated sufficiently that the roller translates to the tipping point, allowing the sear to unload, firing the trigger device. The values of the first and second pull loads $F_1$ and $F_2$ can vary depending on the implementation and individual preferences. Further, although FIG. 5 illustrates the first pull load $F_1$ as being larger than the second pull load $F_2$, the reverse can also be true.

As will be appreciated, an operator of a firearm can adjust the pull loads of both the first stage and the second stage of the trigger device 100, even after it has been installed in a firearm. As described in the '841 patent, the second stage pull load can be adjusted by inserting a tool (not shown) into the socket of the second pull weight adjustment mechanism 190 and rotating the tool. Rotation of the tool causes the threaded wedge screw to move vertically with respect to the housing. The first end of the threaded wedge screw glides along the surface of one of the wedge shaped projections until it falls back into a position between neighboring wedge shaped projections, thereby making a "click" sound. The sound provides feedback to the user indicating that the second pull weight adjustment mechanism 190 has moved to a new position. As the threaded wedge screw rotates with respect to the housing, the spring is either compressed or decompressed, based on the direction of rotation of the threaded wedge screw. In this manner, the amount of force the second pull weight adjustment mechanism 190 exerts on the ticker arm 160*d* is adjusted.

Similarly, the first stage pull load can be adjusted by inserting a tool (not shown) through the hole in the trigger actuation lever 120 and into the socket of the first pull weight adjustment mechanism 180. Rotation of the tool causes the adjustment screw 180*d* to rotate and the nut 180*b* to move within the nut guide 180*c*. The wedge shape protrusions 180*e* on the adjustment screw 180*d* glide along the surface of corresponding wedge shaped protrusions 120*g* on the trigger actuation lever 120*a* until they fall back into a recess between neighboring wedge shaped protrusions, thereby making a "click" sound. The sound provides feedback to the user indicating that the first pull weight adjustment mechanism 180 has moved to a new position. As the nut 180*b* moves within the nut guide 180*c*, the spring 180*a* is either compressed or decompressed, based on the direction of rotation of the nut 180*b*. In this manner, the amount of force the first pull weight adjustment mechanism 180 exerts on the trigger actuation lever 120*a* and the reverser arm 150*c* is adjusted. Further, the interlocking between the wedge shape protrusions 180*e* on the adjustment screw 180*d* and the wedge shaped protrusions 120*g* on the trigger actuation member 120*a* inhibit unintentional or accidental rotation of the nut 180*b* during use of the trigger device 100, thereby reducing a "creep" in the value of the first stage pull load.

Although the embodiments have been described with reference to specific examples, the claims should not be limited by them. For example, although the embodiment described above references a trigger device implemented using a capture roller, other sear/ticker interfaces may also be used. As another example, although the reverser/trigger arrangement described herein is well suited for two-stage triggers, the arrangement can also be implemented in single stage triggers.

Thus, the scope of the claims should not be limited by the preferred embodiments set forth in the examples but should be given the broadest interpretation consistent with the description as a whole.

What is claimed is:

1. A trigger device for activating a firing mechanism, the trigger device comprising:

a housing;

a sear pivotally mounted on the housing via a sear pivot pin; and a trigger pivotally mounted on the housing via a trigger pivot pin, the trigger comprising a trigger extender; and a ticker pivotally mounted on the housing via a ticker pivot pin, the ticker configured to inhibit movement of the sear until the trigger is rotated to a ready position, thereby inhibiting the sear from unloading;

wherein the ticker is configured to unload the sear in response to further pressure applied to the trigger, thereby activating the firing mechanism.

2. The trigger device of claim 1, where the trigger extender abuts the ticker when no pressure is applied to the trigger.

3. The trigger device of claim 2, where the trigger extender is disengaged from the ticker when pressure is applied to the trigger.

4. The trigger device of claim 1, wherein the ticker comprises a notch and rotation of the trigger from the ready position positions the trigger extender proximal the notch, thereby disengaging the trigger extender from the ticker.

5. The trigger device of claim 4, wherein the trigger extender is nestled within the notch when the sear is unloaded.

6. The trigger device of claim 5, wherein notch is configured to inhibit the trigger from returning to the ready position until the sear is reloaded.

* * * * *